US012753767B2

(12) United States Patent
Korupp et al.

(10) Patent No.: US 12,753,767 B2
(45) Date of Patent: Oct. 6, 2026

(54) PUMP DEVICE AND METHOD FOR CARRYING OUT A SERVICE IN A PUMP DEVICE

(71) Applicant: Herborner Pumpentechnik Gmbh & Co KG, Herborn (DE)

(72) Inventors: Sascha Korupp, Asslar-Werdorf (DE); Nils Reeh, Herborn (DE)

(73) Assignee: HERBORNER PUMPENTECHNIK GMBH & CO KG, Herborn (DE)

( * ) Notice: Subject to any disclaimer, the term of this patent is extended or adjusted under 35 U.S.C. 154(b) by 218 days.

(21) Appl. No.: 18/684,951

(22) PCT Filed: Aug. 17, 2022

(86) PCT No.: PCT/EP2022/073017
§ 371 (c)(1),
(2) Date: Feb. 20, 2024

(87) PCT Pub. No.: WO2023/021117
PCT Pub. Date: Feb. 23, 2023

(65) Prior Publication Data

US 2024/0369081 A1 Nov. 7, 2024

(30) Foreign Application Priority Data

Aug. 20, 2021 (DE) ..... 10 2021 121 654.0

(51) Int. Cl.
*F04D 13/06* (2006.01)
*F04D 25/06* (2006.01)
*F04D 29/60* (2006.01)

(52) U.S. Cl.
CPC ..... *F04D 13/06* (2013.01); *F04D 25/06* (2013.01); *F04D 29/60* (2013.01); *F04D 29/603* (2013.01)

(58) Field of Classification Search
CPC ..... F04D 13/06; F04D 25/06; F04D 29/60; F04D 29/603
See application file for complete search history.

(56) References Cited

U.S. PATENT DOCUMENTS 2,947,260 A * 8/1960 Hornschuch ..... F04D 29/628 417/423.12
3,843,185 A * 10/1974 James ..... B66C 1/62 294/67.1

(Continued)

FOREIGN PATENT DOCUMENTS

FR 2633676 1/1990

OTHER PUBLICATIONS

Machine Translation of FR-263676-A1; 1990.*

*Primary Examiner* — Christopher S Bobish
(74) *Attorney, Agent, or Firm* — Millen, White, Zelano & Branigan, P.C.; Christopher W. Brody

(57) ABSTRACT

A pump device has a drive motor, pump hydraulics, and a motor lantern, which is between the drive motor and the pump hydraulics, and an exchange set that can be guided through the motor lantern from an operating position to a removal position and can be removed from the removal position through a removal opening in the motor lantern. A transport device has a motor-operated/manual drive, wherein, the exchange set can be transported from the operating position to the removal position by the transport device. In a method for carrying out service in the pump device, a coupling member is released and the exchange set is moved from the operating position to the removal position by the motor-driven/manually driven transport device. The exchange set is guided through the removal opening in the motor lantern from the removal position into the other removal position to remove the exchange set.

15 Claims, 7 Drawing Sheets

(56) References Cited

U.S. PATENT DOCUMENTS

| | | | | | |
|---|---|---|---|---|---|
| 3,847,504 | A * | 11/1974 | Martin | F04D 29/044 | 415/214.1 |
| 5,287,612 | A * | 2/1994 | Paddock | F04D 29/628 | 29/256 |
| 5,332,373 | A * | 7/1994 | Schendel | F04D 1/12 | 417/424.1 |
| 5,379,519 | A * | 1/1995 | Paddock | B66C 1/24 | 29/256 |
| 7,980,833 | B1 * | 7/2011 | Golden, III | F04D 29/106 | 403/312 |
| 10,280,931 | B2 * | 5/2019 | Prasad DJ | F04D 29/044 | |
| 2008/0206076 | A1 * | 8/2008 | Anwer | F04D 13/021 | 29/700 |
| 2011/0189036 | A1 * | 8/2011 | Long | F04D 29/606 | 417/423.1 |
| 2017/0211580 | A1 * | 7/2017 | Prasad DJ | F04D 13/02 | |

* cited by examiner

PUMP DEVICE AND METHOD FOR CARRYING OUT A SERVICE IN A PUMP DEVICE

FIELD OF THE INVENTION

The invention relates to a pump device as claimed in the preamble of claim 1, and to a method for carrying out a service in a pump device as claimed in claim 12.

BACKGROUND ART

Pumps having a support or motor lantern provided between the motor and the pump hydraulics are used in various industrial plants and in marine engineering. For the purpose of maintenance and repair, so-called replacement kits having, for example a pump mounting, a rear wall of the impeller chamber with a dynamic primary seal and an impeller, first have to be lifted out of the pump housing in the motor lantern, and subsequently removed laterally from the motor lantern. The remaining part of the pump housing, motor lantern and motor remains in an assembled state in the process. Owing to the tight installation situation, the removal of the replacement kit requires a lot of muscular force and nimble handling. Impact damage due to contact between components and hand injuries due to bruising can often result in the process.

SUMMARY OF THE INVENTION

It is an object of the invention to design this replacement of the replacement kit to be easier and less tedious, in particular for the avoidance of impact damage and hand injuries. The solution is to be simple in technical terms and cost-effective.

The object is achieved in that, in a pump device having a drive motor, pump hydraulics, and a motor lantern which is disposed between the drive motor and the pump hydraulics, wherein the pump hydraulics and the motor lantern are disposed along a longitudinal axis, wherein the drive motor has a motor shaft which, by way of at least one coupling member guided by the motor lantern, is connected to a pump shaft of the pump hydraulics, and having a replacement kit which is disposed in an operating position, wherein the replacement kit has a replacement kit housing element and at least one component from the group comprising pump shaft, shaft seal, primary pump seal, mechanical seal, housing seal, bearing and/or seal monitoring sensor system, shaft bearing, bearing support, coupling and pump wheel, and wherein the replacement kit when performing a service is disposed so as to be guidable by the motor lantern from the operating position along the longitudinal axis up to a longitudinal removal position, and is removable from the longitudinal removal position through a removal opening in the motor lantern, there is provision to provide a mechanical and/order hydraulic and/or pneumatic transport device having a motorized and/or manual drive, wherein the replacement kit when performing a service is able to be transported from the operating position up to the longitudinal removal position by means of the transport device. The replacement kit therefore does not have to be manually handled within the motor lantern and moved out of the operating position. Moreover, the transport device is conceived in such a manner that an operator does not have to support the full weight of the replacement kit. The transport device facilitates transportation at least partially along the longitudinal axis and correspondingly relieves the operator when performing a service.

Typical pump hydraulics as potentially configured according to the invention have a pump housing. The pump housing forms a cavity into which opens an inlet opening and which opens into an outlet opening, wherein a pump wheel is disposed in the cavity, in particular so as to induct a fluid at the inlet opening and convey said fluid through the outlet opening. The pump wheel is disposed so as to be rotatable, in particular so as to rotate in the pump housing. The pump wheel is driven by the pump shaft. The drive motor preferably drives the pump shaft or the at least one coupling member directly, or indirectly by way of a gearbox. The drive motor, the pump hydraulics and the motor lantern can be disposed along the longitudinal axis. The conveying function of the pump hydraulics is enabled in the operating position.

The motor lantern should be placed between the pump hydraulics and the drive motor. Said motor lantern is a connecting peace between the pump hydraulics and the drive motor, so to speak. The motor lantern could also be referred to as a connecting peace. The motor lantern forms a lantern cavity. The longitudinal axis extends through the lantern cavity. The motor lantern has the removal opening. The removal opening is advantageously disposed laterally in terms of the longitudinal axis in the motor lantern. The replacement kit is removable transversely to the longitudinal axis through the removal opening. For removal, the replacement kit is situated in the longitudinal removal position.

The replacement kit contains essential components of the pump that are at risk of wear. The respective components can be easily serviced or replaced by virtue of the replacement kit being removed from the pump. The replacement kit housing element and the at least one component form a conjointly removable unit. In this sense, the at least one component is fastened to the replacement kit housing element. The replacement kit housing element can be configured as a closed housing or a pump wall, in particular a pump rear wall of the pump housing, or as a portion of the pump housing.

It is to be understood that the mechanical transport devices should also include, inter alia, special cases such as a magnetically, hydraulically or electromagnetically acting transport device. However, classic mechanical transport devices (thus excluding such special cases) are also explicitly the subject matter of the invention. Furthermore, a mechanical transport device may have a gearbox or a crank handle for manual operation.

The replacement kit housing is preferably guidable along the longitudinal axis and/or parallel to and/or coaxially with the longitudinal axis. Alternatively, said replacement kit housing can also be guided on an arbitrary path.

Moreover, it can be advantageous for the transport device to be configured to be self-locking. In particular, said transport device can be configured to be self-locking in such a manner that the replacement kit is held in the longitudinal removal position once the latter has been reached. It is prevented in this way that the replacement kit drops back to the operating position when being transported to the longitudinal removal position, or upon reaching the longitudinal removal position, should the drive no longer exert any force.

It is furthermore advantageous for the transport device to have a hoist or a lifting device by way of which the replacement kit is able to be transported from the operating position to the longitudinal removal position. The hoist and/or the lifting device can at least exert part of the force required for transporting the replacement kit. Transportation is easier as a result.

It can also be advantageous for the hoist to be configured as a pulling tool which when performing a service is able to be fastened on the replacement kit, wherein a tensile force acting on the replacement kit is able to be exerted by way of the pulling tool. The hoist is easy to handle as a result of the configuration of the pulling tool. The pulling tool can in particular be configured as a cable pull. The hoist is operated manually, electrically, hydraulically, pneumatically and/or in a motorized manner. The tensile force can act along the longitudinal axis. The hoist should have a coupling element which is able to be brought to engage with a coupling geometry on the replacement kit, in particular the pump shaft or the replacement kit housing element. Furthermore, the hoist can at least have one or a plurality of deflection rollers. The deflection roller should be disposed within the motor lantern.

Moreover, it is advantageous for the drive to have a hoisting winch. A pulling element of the hoist can be able to be wound and unwound by means of the hoisting winch. Furthermore, the hoisting winch can be disposed above the longitudinal removal position. Moreover, the hoisting winch can be disposed and/order fastened on the outside of the motor lantern. The drive can moreover have an electric motor, hydraulic motor, compressed air motor, or a crank handle by means of which the pulling element is able to be wound and unwound.

It can likewise be advantageous for the replacement kit in the operating position to be disposed at least partially, preferably completely, within the motor lantern. In particular in the case of such a construction, the transport device can simplify the removal and installation of the replacement kit.

Moreover, it can be furthermore advantageous for the transport device to have at least one guide element by way of which the replacement kit when performing a service is guidable from the longitudinal removal position in the motor lantern up to a removal position, wherein the replacement kit in the removal position is disposed at least partially outside the motor lantern. The replacement kit should in particular be guidable transversely to the longitudinal axis. In the removal position, the replacement kit is in particular disposed so as to be at least halfway outside the motor lantern. The further removal is easily possible if the replacement kit is disposed at least partially outside the motor lantern.

It is furthermore an advantageous aspect for at least one guide element to be configured as a transport rail for the replacement kit. The guide element or the guide elements can be formed by elements of a support frame with bars. The bars of the support frame are, for example, support bars and/or a guide bars. A support bar runs at least substantially along the longitudinal axis. A guide bar runs transversely to the longitudinal axis. The guide element or the guide elements can be formed by one bar or a plurality of bars of the support frame, in particular one guide bar or a plurality of guide bars. The support frame can be supported on a base frame and/or on the motor lantern. The guide bars are supported by way of the support bars in such a manner that the former remain in the orientation transverse to the longitudinal axis even when loaded by the replacement kit. The configuration of the guide element as a transport rail is simple because the transport rail can be rapidly and easily constructed when performing a service. This also applies to the support frame. The transport rail and/or the support frame can easily be dismantled again after the replacement has been carried out.

Moreover, it is advantageous for the at least one coupling member between the motor shaft and the pump shaft to be detachable. In this way, a movement of the replacement kit between the operating position and the longitudinal removal position is cleared when performing a service. The coupling member can be encased by a coupling protection which is detachable when performing a service. The removal of the replacement kit is thus easily possible.

According to a more detailed design embodiment it is provided that the longitudinal axis is vertically aligned in geodetic terms. This means that the pump device is vertically aligned in geodetic terms in such a manner that the longitudinal axis is vertically aligned, wherein the pump hydraulics are preferably disposed below the motor lantern in geodetic terms. A space-saving pump assembly is achieved as a result.

Optionally, a base frame and/or a contact area can be disposed below the pump hydraulics in geodetic terms, so as to set up the pump device vertically in geodetic terms, in particular in such a manner that the pump hydraulics are disposed below the motor lantern in geodetic terms. In this context, the base frame enables the pump device to be set up.

The object is also achieved by a method for carrying out a service on a pump device, wherein the pump device has a drive motor, pump hydraulics having a pump shaft and a motor lantern between the drive motor and the pump hydraulics, wherein the pump hydraulics and the motor lantern are disposed along a longitudinal axis, wherein the drive motor has a motor shaft which, by way of at least one coupling member guided by the motor lantern, is connected to the pump shaft, and wherein the pump device has a replacement kit which is disposed in an operating position, wherein the replacement kit has a replacement kit housing element and at least one component from the group comprising pump shaft, shaft seal, primary pump seal, mechanical seal, bearing and/or seal monitoring sensor system, housing seal, shaft bearing, bearing support, coupling and pump wheel, said method comprising the following steps: a) releasing the coupling member; b) mechanically and/or hydraulically and/or pneumatically moving the replacement kit from the operating position up to a longitudinal removal position by means of a motorized and/or manually driven transport device; c) guiding the replacement kit from the longitudinal removal position through a removal opening of the motor lantern to a removal position; d) removing the replacement kit. For removal, the replacement kit can in particular be guided transversely to the longitudinal axis through the lateral removal opening. The transport device facilitates transportation at least partially along the longitudinal axis and correspondingly relieves the operator when performing a service.

In this context, it can be advantageous for the method to be applied to a pump device as described above and hereunder. The advantages of the pump device as described are thus incorporated in an analogous manner in the method. The invention thus also relates to a corresponding method for carrying out a service on a pump device as described above and hereunder.

In an optional design embodiment of the method it is provided that guiding according to step c) is performed manually along at least one guide element of the transport device. Manual guiding is cost-effective.

It is also advantageous between steps b) and c) herein for the guide element or the guide elements to be brought to engage with the replacement kit. This furthermore enables a compact construction mode of the pump device, because the additional components are installed only when performing a service.

During step c), the replacement kit is preferably supported by the guide element or guide elements. To this extent, the guide elements support the replacement kit and relieve the operator.

Optionally, steps a), b), c) and d) can be carried out in reverse in order to insert a new or refurbished replacement kit into the operating position. An easy installation of the replacement kit is possible in this way.

DETAILED DESCRIPTION OF THE DRAWINGS

Figure 1:
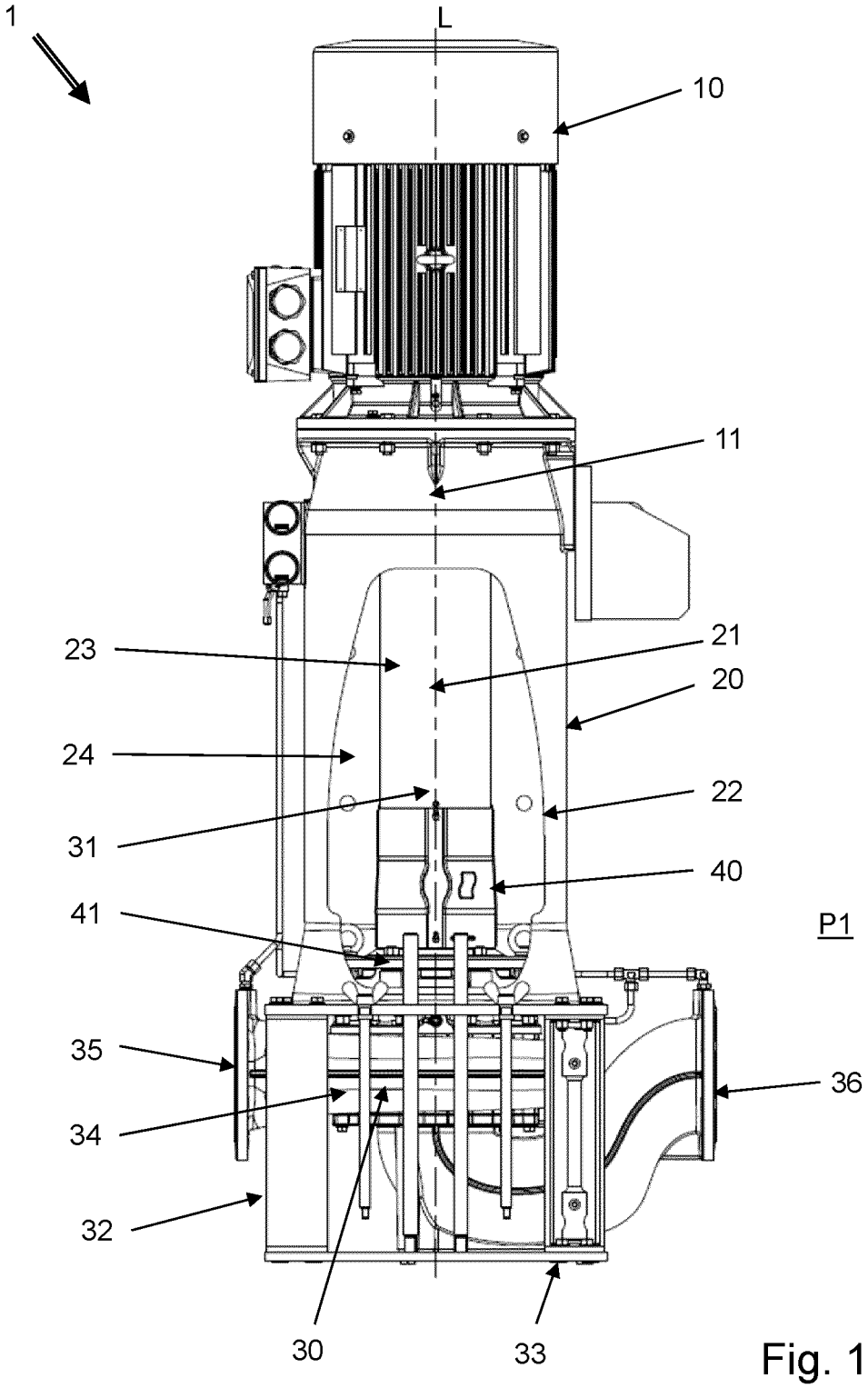
FIG. 1 shows a lateral view of a pump device having a replacement kit in the operating position.

According to FIG. 1, a pump device 1 has a drive motor 10 and pump hydraulics 30. The pump hydraulics 30 have a pump housing. The pump housing forms a cavity 34 into which opens an inlet opening 35 and which opens into an outlet opening 36. A pump wheel 45 (not illustrated, cf. FIG. 2) is disposed in the cavity 34 so as to induct a fluid at the inlet opening 35 and convey said fluid through the outlet opening 36.

Figure 5:
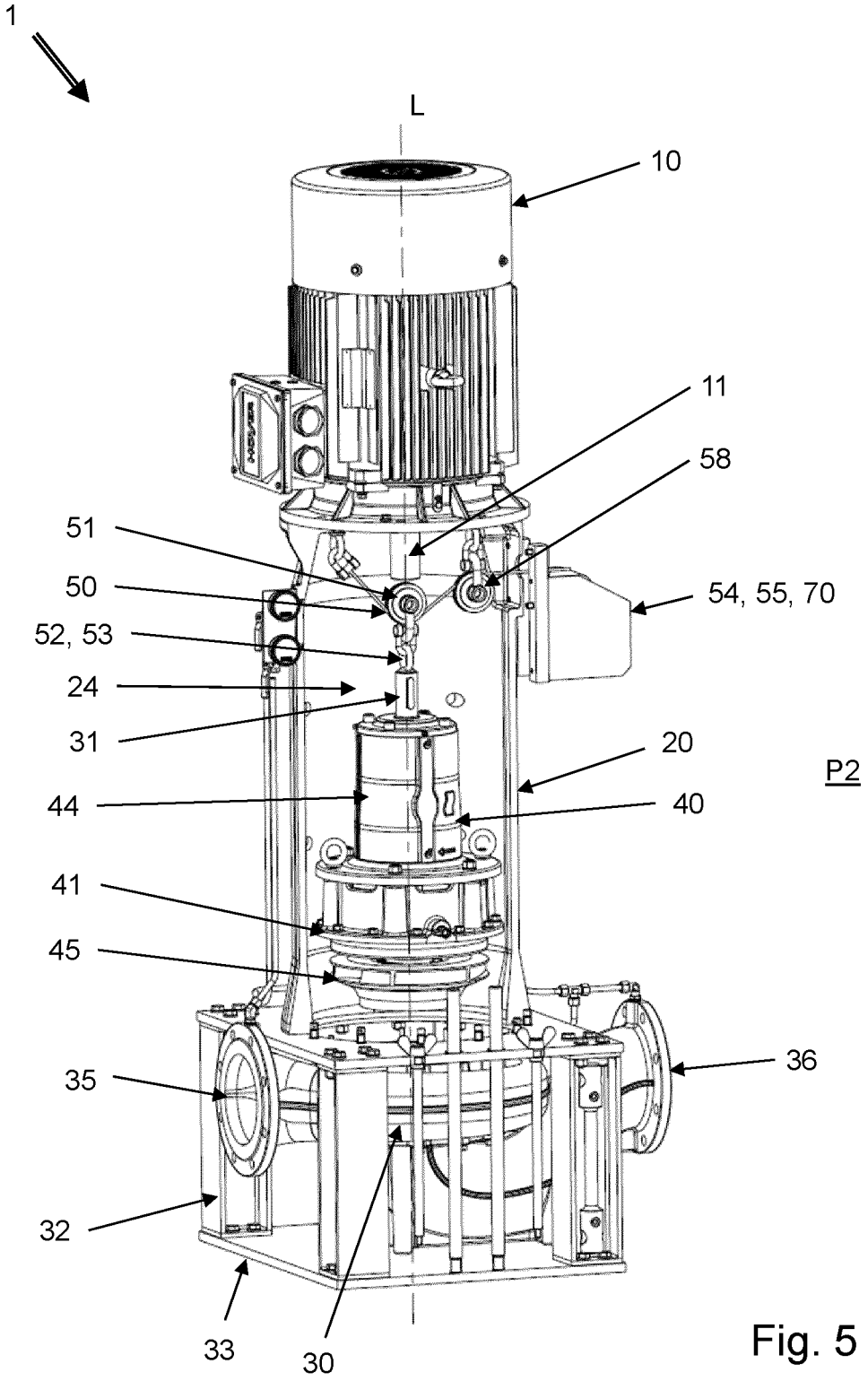
FIG. 5 shows a lateral view of a pump device with a partial longitudinal sectional view of the motor lantern and with a replacement kit in a longitudinal removal position.

Moreover provided is a motor shaft 11 (lies so as to be obscured in the upper region of the motor lantern, cf. also FIG. 5) on the drive motor 10, and a pump shaft 31 (lies so as to be obscured, cf. FIG. 2) on the pump hydraulics 30. The pump wheel 45 is disposed so as to rotate in the pump housing, wherein the rotation of the pump wheel 45 is able to be driven by way of the pump shaft 31. The rotation can be effected by means of a force flux between the motor shaft 11, which is driven by the drive motor 10, a coupling member 21 and the pump shaft 31. The coupling member 21 is encased by a coupling protection 23 and correspondingly cannot be seen. The pump shaft 31 herein is connected directly to the coupling member 21. Alternatively, an intervening gearbox or a clutch can be provided (not illustrated).

Placed between the pump hydraulics 30 and the drive motor 10 is a motor lantern 20. The drive motor 10, the pump hydraulics 30 and the motor lantern 20 are disposed along the longitudinal axis L. The motor lantern 20 forms a lantern cavity 24. The longitudinal axis L runs through the lantern cavity 24. The motor lantern 20 has a lateral removal opening 22 which is disposed transversely to a longitudinal axis L. The coupling member 21 lies within the lantern cavity 24.

As is illustrated, a replacement kit 14 which is disposed in an operating position P1 is provided. The replacement kids 40 in the operating position P1 is disposed so as to be at least partially, presently completely, within the motor lantern 20. The replacement kit 40 comprises a replacement kit housing element 41 which is disposed within the lantern cavity 24.

The pump device 1 is vertically aligned in geodetic terms in such a manner that the longitudinal axis L is vertically aligned, wherein the pump hydraulics 30 are disposed below the motor lantern 20 in geodetic terms. Disposed below the pump hydraulics 30 is a contact area 33 of a base frame 32, so as to set up the pump device 1 vertically in geodetic terms, wherein the pump hydraulics 30 are disposed below the motor lantern 20 in geodetic terms.

Figure 2:
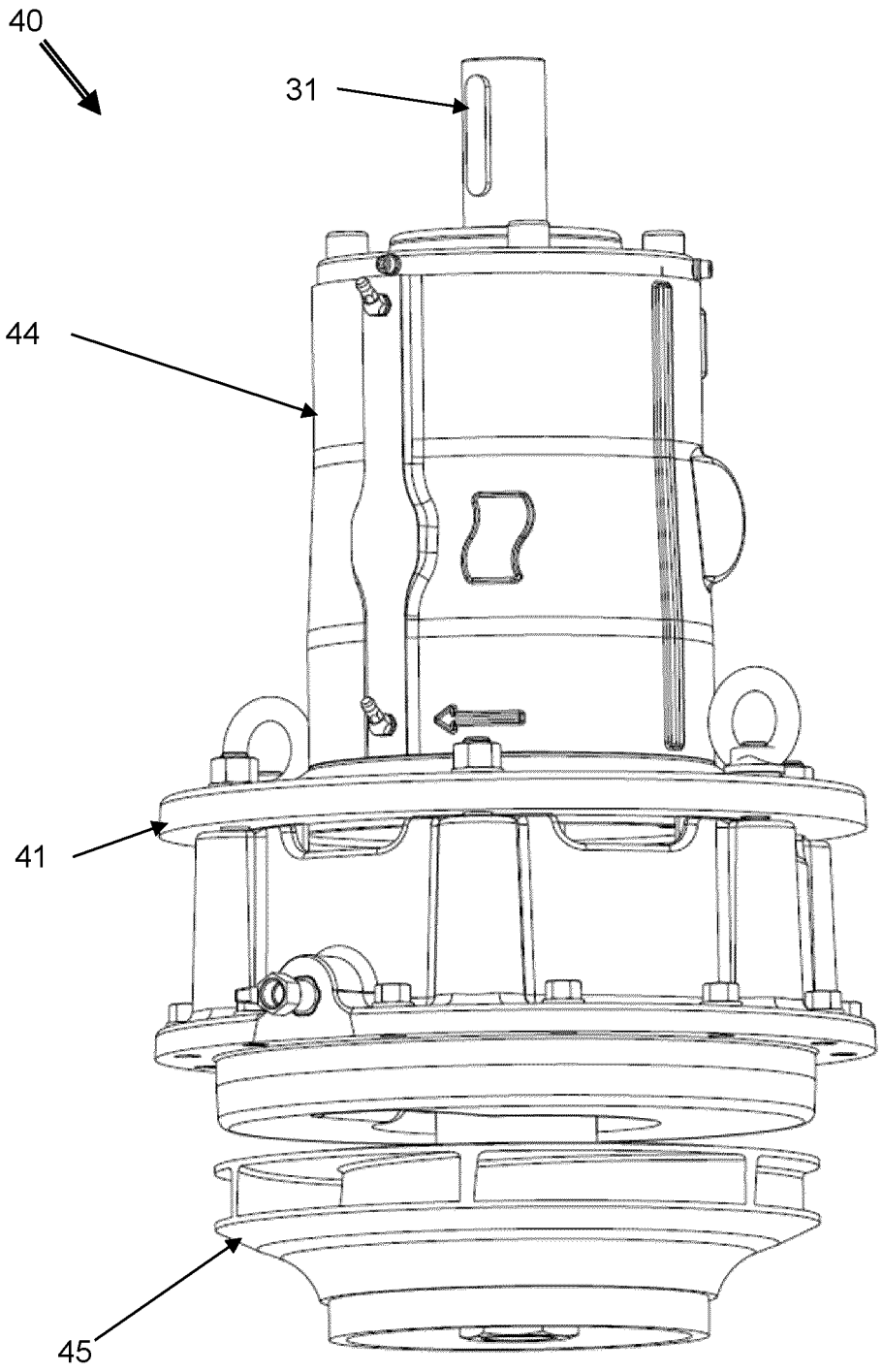
FIG. 2 shows a perspective view of a replacement kit.
Figure 3:
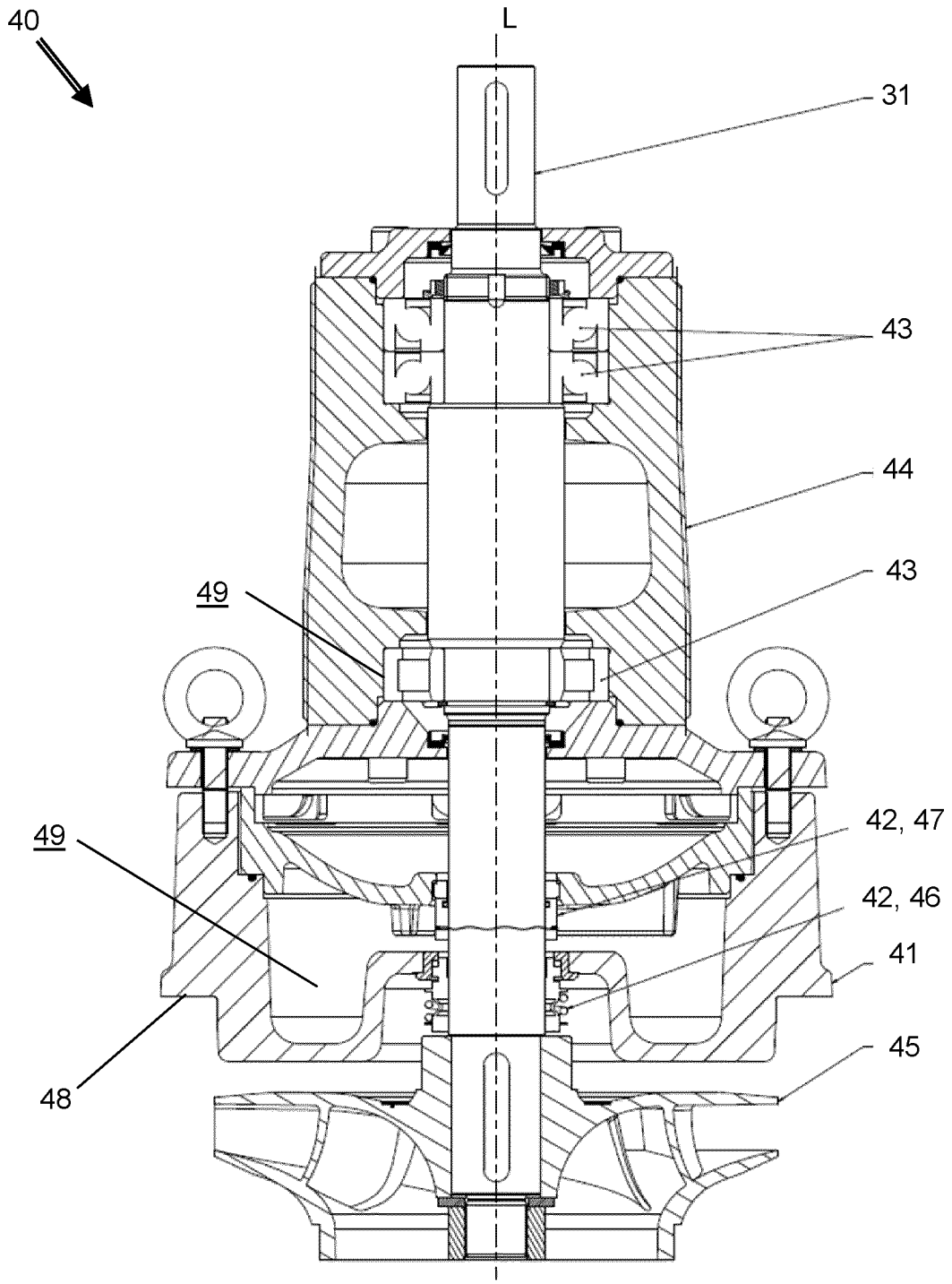
FIG. 3 shows a longitudinal section through the replacement kit as per FIG. 2.

Moreover, the replacement kit 40 according to FIGS. 2 und 3 comprises further components of the pump that are at risk of wear. These include the pump shaft 31, shaft seals 42, presently in particular a primary pump seal 46 and a secondary mechanical seal 47, a housing seal 48 (only the position denoted, not illustrated), a bearing and a seal monitoring sensor system 49, two shaft bearings 43, a bearing support 44 for the latter, and a pump wheel 45. The replacement kit housing element 41 and the components form a conjointly removable unit and to this extent the components are fastened directly or indirectly to the replacement kit housing element 40, or form part thereof. The replacement kit housing element 41 is configured as a pump rear wall of the pump housing.

Figure 4:
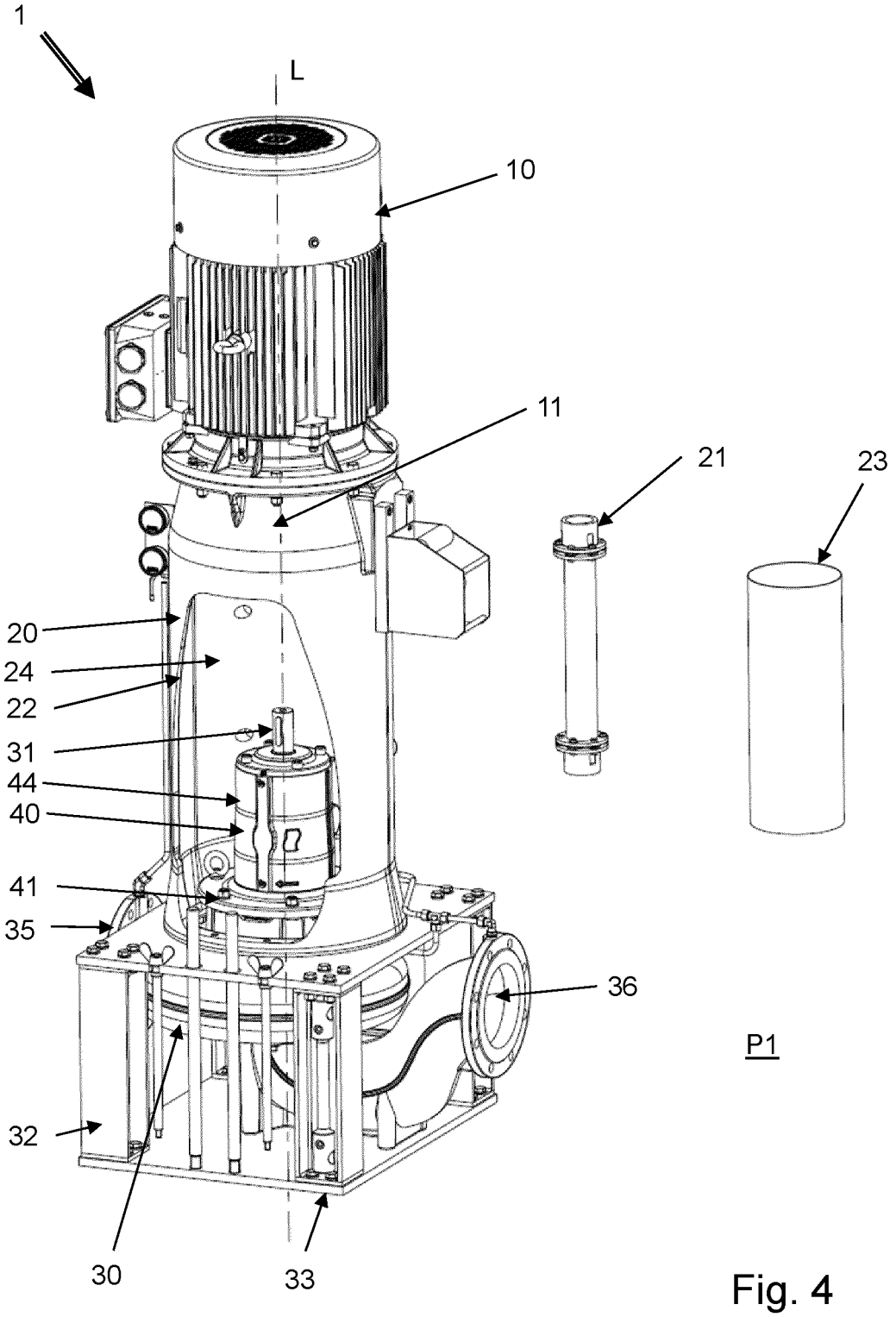
FIG. 4 shows a perspective lateral view of a pump device having an uninstalled coupling member.

As per FIG. 4, the coupling protection 23 and the coupling member 21 have been released and disassembled as a first step a) for the removal of the replacement kit 40. To this extent, the replacement kit 40 is guidable between the operating position P1 and a longitudinal removal position P2, because the movement within the lantern cavity 24 is correspondingly cleared by having disassembled the coupling protection 23 and the coupling member 21.

According to FIG. 5, a step b) has been carried out in which the replacement kit 40 is guided from the operating position P1 along the longitudinal axis L up to a longitudinal removal position P2 by the motor lantern 20. A transport device 50 is provided for this purpose. The transport device 50 has a hoist 51. The hoist 51 is configured as a pulling tool, in particular as a cable pull, by way of which a tensile force acting along the longitudinal axis L is able to be exerted on the replacement kit 40. The hoist 51 has a coupling element 52 which can be brought to engage with a coupling geometry 53 on the pump shaft 31, so that a force flux between the hoist 51 and the replacement kit 40 is guaranteed. The coupling geometry 53 presently is an external thread which is screwed into a threaded bore in the end side of the pump shaft 31. The hoist 51, or the pulling tool, has deflection rollers 58 which are disposed within the motor lantern 20, in particular in the lantern cavity 24. Moreover, the hoist 51 configured as a cable pull is disposed within the motor lantern 20, in particular the lantern cavity 24. Furthermore, the transport device 50 is configured to be self-locking so that the replacement kit 40 is held in the longitudinal removal position P2 without any further force having to act thereon.

Figure 6:
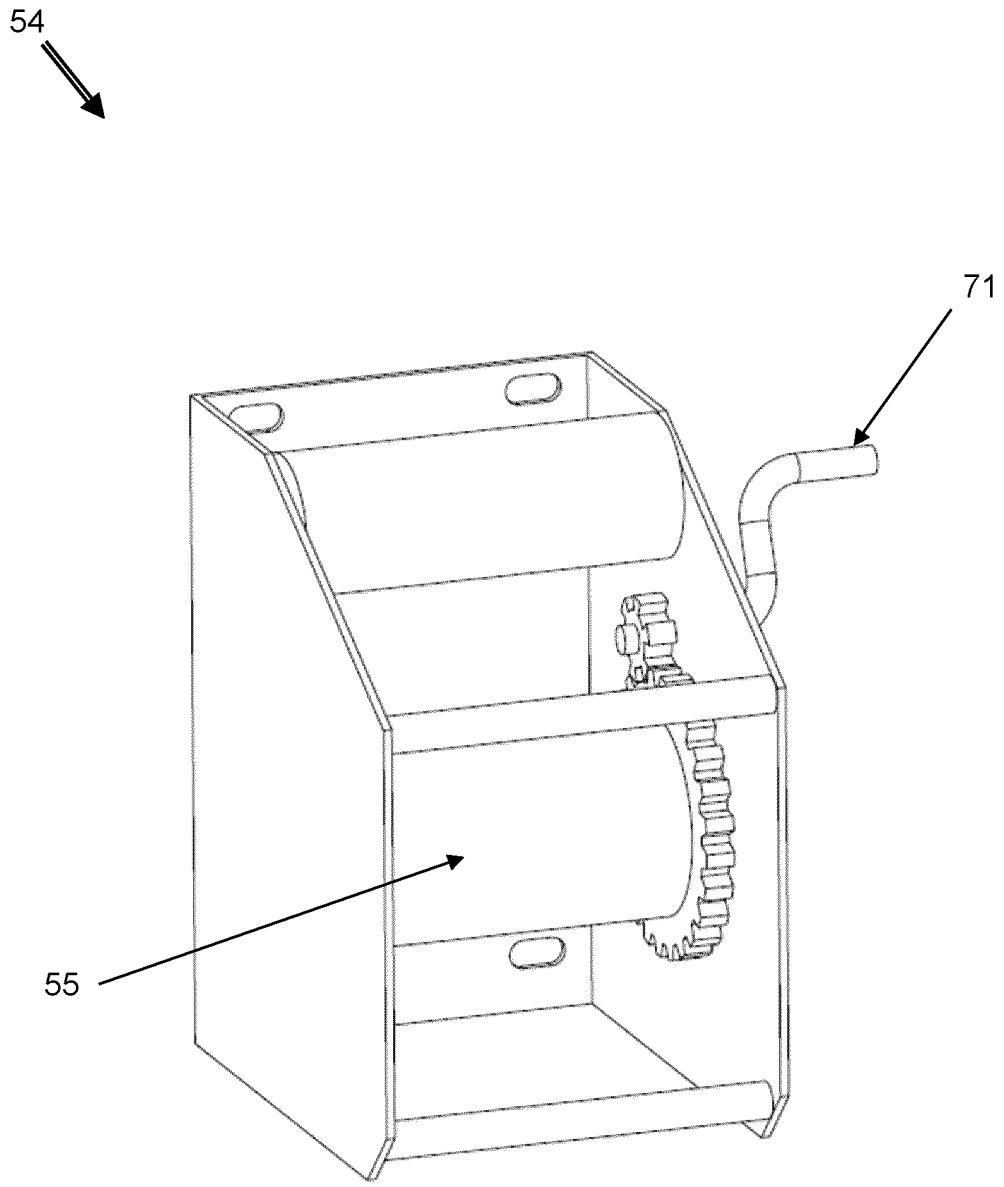
FIG. 6 shows an optional drive of a transport device.

The drive 54 has a hoisting winch 55. The cable pull of the hoist 51 is able to be wound and unwound by means of the hoisting winch 55. The hoisting winch 55 in terms of the longitudinal axis L is disposed above the longitudinal removal position P2. The hoisting winch 55 is disposed or fastened on the outside of the motor lantern 20. The drive 54 moreover has an electric motor 70 by means of which the pulling element is able to be wound and unwound. Alternatively, a crank handle 71 having a crank mechanism can be provided, as is illustrated in FIG. 6. To this extent, the hoist 51 is able to be operated manually or in a motorized manner.

In the longitudinal removal position P2, the replacement kit 40 is able to be guided and removed transversely to the longitudinal axis L through the lateral removal opening 22.

Figure 7:
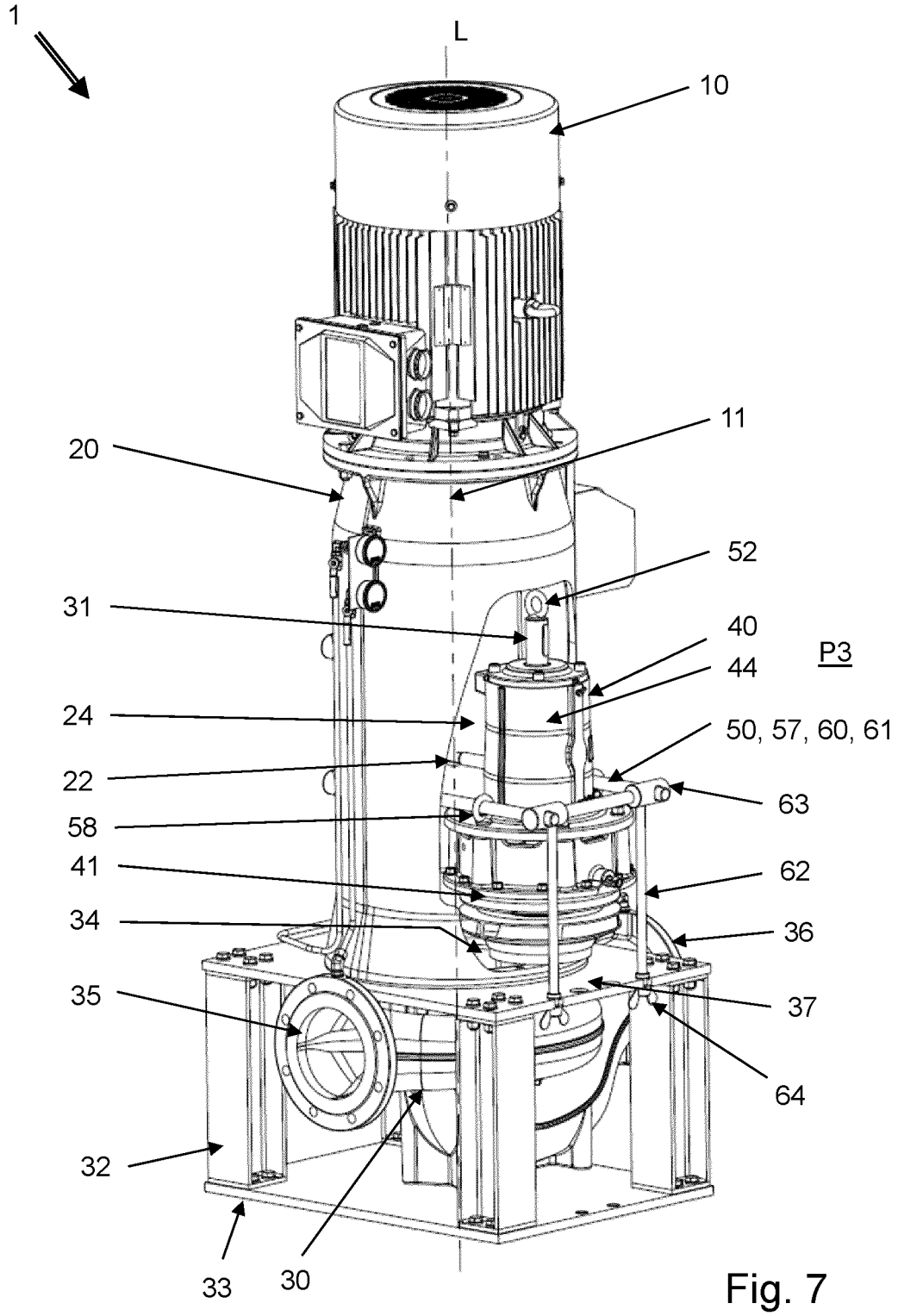
FIG. 7 shows the pump device with a replacement kit in the removal position.

As per FIG. 7, in a step c), the replacement kit 40 is guided transversely to the longitudinal axis L from the longitudinal removal position P2 in the motor lantern 20 up to a removal position P3. In the removal position P3, the replacement kit 40 is disposed partially outside the motor lantern 20, at least to an extent of more than 50%, so that the replacement kit 44 for further transport can be hooked to an external crane, for example. For this purpose, the coupling element 52 remains on the pump shaft 31. A support frame 60 is provided in order for the replacement kit 40 to be moved to the removal position P3 shown. The support frame 60 has two support bars 62 and two guide bars 61. The support bars 62 run along the longitudinal axis L but may also be obliquely aligned. The guide bars 61 run transversely to the longitudinal axis L. The support bars 62 are supported on a support face 37 of the base frame 32, and fixed from below using wing nuts 64. The support bars 62 are connected to the guide bars 61 by means of supporting members 63. Moreover, the guide bars 61 are connected to the motor lantern 20. The guide bars 61 are brought to engage with the replacement kit 40 by way of a guide coupling geometry 58, presently in particular suspension eyes 41, of the replacement kit 40, in particular presently fastened on the replacement kit housing element 41. Accordingly, the guide bars 61 are configured as guide elements 57, consequently transport rails which support the replacement kit 40 when guided along the guide elements 57. The supporting members 63 and the motor lantern 20 support the guide bars 61 in such a manner in the process that the latter remain in the orientation transverse to the longitudinal axis L when loaded by the replacement kit 40. The replacement kit 40 is presently manually guided between the longitudinal removal position P2 and the removal position P3.

In the removal position P3, the replacement kit 40 is removable in a step d), either manually or using an external crane, depending on the weight. Prior thereto, the hoist 51 should be separated, as has already taken place in FIG. 7.

A new or serviced replacement kit 40 can be moved into the operating position P1 according to FIG. 1 by reversing steps a) to d).

It can be seen in FIG. 1 that the sub-elements of the support frame 60 are stowed on the base frame 32 when not in use, the latter having receptacles for this purpose, in particular in the manner of hanger units in which all the sub-elements are suspended.

The invention is not limited to one of the embodiments described above, but may be modified in many different ways.

All of the features and advantages, including structural details, spatial arrangements and method steps, which are derived from the claims, the description and the drawing may be essential to the invention individually as well as in the most varied combinations.

| List of reference signs | |
|---|---|
| 1 | Pump device |
| 10 | Drive motor |
| 11 | Motor shaft |
| 20 | Motor lantern |
| 21 | Coupling member |
| 22 | Removal opening |
| 23 | Coupling protection |
| 24 | Lantern cavity |

-continued

| List of reference signs | |
|---|---|
| 30 | Pump hydraulics |
| 31 | Pump shaft |
| 32 | Base frame |
| 33 | Contact area |
| 34 | Cavity |
| 35 | Inlet opening |
| 36 | Outlet opening |
| 37 | Support face |
| 40 | Replacement kit |
| 41 | Replacement kit housing element |
| 42 | Shaft seal |
| 43 | Shaft bearing |
| 44 | Bearing support |
| 45 | Pump wheel |
| 46 | Primary pump seal |
| 47 | Mechanical seal |
| 48 | Housing seal |
| 49 | Bearing and/or seal monitoring sensor system |
| 50 | Transport device |
| 51 | Hoist, lifting device |
| 52 | Coupling element |
| 53 | Coupling geometry |
| 54 | Drive |
| 55 | Hoisting winch |
| 57 | Guide element, transport rail |
| 58 | Guide coupling geometry |
| 60 | Support frame |
| 61 | Guide bar |
| 62 | Support bar |
| 63 | Supporting member |
| 64 | Wing nut |
| 70 | Electric motor |
| 71 | Crank handle |
| L | Longitudinal axis |
| P1 | Operating position |
| P2 | Longitudinal removal position |
| P3 | Removal position |

The invention claimed is:

1. A pump device (1) having a drive motor (10), pump hydraulics (30), and a motor lantern (20) which is disposed between the drive motor (10) and the pump hydraulics (30), wherein the pump hydraulics (30) and the motor lantern (20) are disposed along a longitudinal axis (L), wherein the drive motor (10) has a motor shaft (11) which, by way of at least one coupling member (21) guided by the motor lantern (20), is connected to a pump shaft (31) of the pump hydraulics (30), and having a replacement kit (40) which is disposed in an operating position (P1), wherein the replacement kit (40) has a replacement kit housing element (41) and at least one component from the group comprising pump shaft (31), shaft seal (42), primary pump seal (46), mechanical seal (47), housing seal (48), bearing and/or seal monitoring sensor system (49), shaft bearing (43), bearing support (44), coupling and pump wheel (45), wherein the replacement kit (40) when performing a service is disposed so as to be guidable by the motor lantern (20) from the operating position (P1) along the longitudinal axis (L) up to a longitudinal removal position (P2), and is removable from the longitudinal removal position (P2) through a removal opening (22) in the motor lantern (20), wherein a mechanical and/or hydraulic and/or pneumatic transport device (50) is provided having a motorized and/or manual drive (54), wherein the replacement kit (40), when performing a service is able to be transported from the operating position (P1) up to the longitudinal removal position (P2) by means of the transport device (50), wherein the motorized and/or manual drive (54) has a hoisting winch (55), wherein the transport device (50) has a hoist (51) by way of which the replacement kit (40) is able to be transported from the operating position (P1) to the longitudinal removal position (P2), and wherein the hoist (51) has at least one or a plurality of deflection rollers (58), and wherein the at least one deflection roller (58) or plurality of deflection rollers (58) is disposed within the motor lantern (20), and the hoisting winch (55) being disposed and/or fastened on the outside of the motor lantern (20).

2. The pump device (1) as claimed in claim 1, characterized in that the transport device (50) is configured to be self-locking.

3. The pump device (1) as claimed in claim 1, characterized in that the hoist (51) is configured as a pulling tool which when performing a service is able to be fastened on the replacement kit (40), wherein a tensile force acting on the replacement kit (40) is able to be exerted by way of the pulling tool.

4. The pump device (1) as claimed in claim 1, characterized in that the replacement kit (40) in the operating position (P1) is disposed at least partially within the motor lantern (20).

5. The pump device (1) as claimed in claim 1, characterized in that the transport device (50) has at least one guide element (57) by way of which the replacement kit (40) when performing a service is guidable from the longitudinal removal position (P2) in the motor lantern (20) up to a removal position (P3), wherein the replacement kit (40) in the removal position (P3) is disposed at least partially outside the motor lantern (20).

6. The pump device (1) as claimed in claim 5, characterized in that the at least one guide element (57) is configured as a transport rail for the replacement kit (40).

7. The pump device (1) as claimed in claim 1, characterized in that the at least one coupling member (21) between the motor shaft (11) and the pump shaft (31) is detachable.

8. The pump device (1) as claimed in claim 1, characterized in that the longitudinal axis (L) is vertically aligned in geodetic terms.

9. The pump device (1) as claimed in claim 1, characterized in that a base frame (32) and/or a contact area (33) are/is disposed below the pump hydraulics (30) in geodetic terms, so as to set up the pump device (1) vertically in geodetic terms, in particular in such a manner that the pump hydraulics (30) are disposed below the motor lantern (20) in geodetic terms.

10. A method for carrying out a service on a pump device (1) according to claim 1, said method comprising the following steps:

a) releasing the coupling member (21);

b) mechanically and/or hydraulically and/or pneumatically moving the replacement kit (40) from the operating position (P1) up to a longitudinal removal position (P2) by means of the motorized and/or manually driven transport device (50);

c) guiding the replacement kit (40) from the longitudinal removal position (P2) through a removal opening (22) of the motor lantern (20) to a removal position (P3);

d) removing the replacement kit (40).

11. The method as claimed in claim 10, wherein the replacement kit (40) of the pump device, when performing a service, is disposed so as to be guidable by the motor lantern (20) from the operating position (P1) along the longitudinal axis (L) up to the longitudinal removal position (P2), and is removable from the longitudinal removal position (P2) through the removal opening (22) in the motor lantern (20), and the transport device (50) having the motorized and/or manual drive (54), wherein the replacement kit (40) when performing a service is able to be transported from the operating position (P1) up to the longitudinal removal position (P2) by means of the transport device (50).

12. The method as claimed in claim 10, wherein guiding according to step c) is performed manually along at least one guide element (57) of the transport device (50).

13. The method as claimed in claim 12, wherein between steps b) and c) the guide element or guide elements (57) is/are brought to engage with the replacement kit (40).

14. The method as claimed in claim 12, wherein during step c.) the replacement kit (40) is supported by the guide element or guide elements (57).

15. The method as claimed in claim 10, wherein steps a), b), c) and d) are carried out in reverse in order to insert a new or refurbished replacement kit (40) into the operating position (P1).

* * * * *